US009506296B2

(12) United States Patent
Miller

(10) Patent No.: US 9,506,296 B2
(45) Date of Patent: Nov. 29, 2016

(54) DRILL BIT ALLOY

(76) Inventor: Robert Kenneth Miller, Delta (CA)

( * ) Notice: Subject to any disclaimer, the term of this patent is extended or adjusted under 35 U.S.C. 154(b) by 788 days.

(21) Appl. No.: 13/814,651

(22) PCT Filed: Aug. 6, 2010

(86) PCT No.: PCT/CA2010/001197

§ 371 (c)(1),
(2), (4) Date: Feb. 6, 2013

(87) PCT Pub. No.: WO2012/016317

PCT Pub. Date: Feb. 9, 2012

(65) Prior Publication Data

US 2013/0140095 A1 Jun. 6, 2013

(51) Int. Cl.

| | |
|---|---|
| ***C22C 29/08*** | (2006.01) |
| ***E21B 10/48*** | (2006.01) |
| ***E21B 10/02*** | (2006.01) |
| *B22F 5/00* | (2006.01) |

(52) U.S. Cl.

CPC ..... *E21B 10/48* (2013.01); *E21B 10/02* (2013.01); *B22F 2005/001* (2013.01); *B22F 2998/00* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 1,986,197 A | | 1/1935 | Harshaw | |
| 2,933,415 A | | 4/1960 | Homer et al. | |
| 3,173,314 A | | 4/1965 | Blackmer | |
| 4,128,136 A | * | 12/1978 | Generoux | B28D 1/041 175/379 |
| 4,833,040 A | | 5/1989 | Fishman et al. | |
| 5,240,742 A | | 8/1993 | Johnson et al. | |
| 5,932,508 A | * | 8/1999 | Armstrong | C22C 26/00 51/309 |
| 2008/0073127 A1 | * | 3/2008 | Zhan | B24D 3/02 175/434 |
| 2010/0263938 A1 | * | 10/2010 | Scott | E21B 10/54 175/428 |

FOREIGN PATENT DOCUMENTS

WO 2009042380 A1 4/2009

OTHER PUBLICATIONS

International Searching Authority, "International Search Report and Written Opinion", for International Application No. PCT/CA2010/001197.

* cited by examiner

*Primary Examiner* — George Wyszomierski
*Assistant Examiner* — Ngoclan T Mai
(74) *Attorney, Agent, or Firm* — Brion Raffoul

(57) ABSTRACT

A drill bit matrix is provided that contains a powdered abrasive material and a refractory metal powder in which the refractory metal powder is a coated powder in which each granule of the refractory metal powder is coated by a coating material. A core drill bit is further provided, containing a powdered abrasive material, a refractory metal powder and a steel tube onto which the powdered abrasive material and refractory metal powder are alloyed. The refractory metal powder is a coated powder in which each granule of the refractory metal powder is coated by one or more coating materials. A method is finally provided for manufacturing a core drill bit. First a matrix is formed by mixing together a powdered abrasive material and a coated refractory metal powder. The matrix is placed in a mould and a steel tube is placed on top of the mould to form a drill bit assembly. The drill bit assembly is then heated under atmospheric conditions. The steel tube is then hot pressed into the heated matrix and the drill bit assembly is allowed to cool before releasing the cooled drill bit from the mould.

29 Claims, 6 Drawing Sheets a)

b)

DRILL BIT ALLOY

FIELD OF THE INVENTION

This invention relates to matrices for use in the manufacture of drill bits.

BACKGROUND

In the production of core drill bits for boring into hard rock and similarly hard formations, an abrasive grit material is incorporated in to the bit matrix to improve cutting and reduce drill bit wear. This abrasive grit material can be a number of different abrasive particles including diamond grit and synthetic diamond grit.

The remaining portion of the drill bit is often made up of refractory metal powders, the most common being tungsten, and an infiltrant.

In manufacturing the core drill bit, a matrix is first formed by mixing the refractory metal powder and the abrasive grit material, together with a organic binder material, which helps to hold the abrasive grit particles place. The matrix is placed in a mould and a steel tube in placed on top of the mould, onto which the matrix will be alloyed. An infiltrant is then arranged around the steel tube, in such a way that melted infiltrant will run interstitially between the particles of refractory metal powder and abrasive grit material in the mold and promote wetting and adhesion to the steel tube. The entire assembly is then heated to at or above the liquidus temperature of the infiltrant and the infiltrant permeates the assembly and forms a strong and solid alloy around the steel tube.

In choosing a suitable metal powder or refractory metal powder, it is desirable to select one that has a very high melting point and will not melt or deform during furnacing. This is important to ensure that the abrasive grit particles stay exactly where they were placed when the powders are mixed and placed in the mould.

It is further desirable that the matrix achieves fast cutting rates while providing the above high melting point and strength. A number of refractory metal powders have shown promise in the past in this respect.

However, at the high furnacing temperatures required for alloying it is important not to let the metal powder become oxidized in the furnacing process. This is a common problem with a number of different metals that would otherwise be suitable for use in core drill bits for hard rock drilling purposes. Oxidation, or rust, covers the surface of the refractory metal powder and inhibits good adhesion and wetting with the infiltrant. This leads to a weak and poorly alloyed drill bit of compromised strength.

Attempts have been made to inhibit oxidation during the furnacing process. Most commonly, the furnacing atmosphere has been purged of oxygen and filled with hydrogen. Furnacing in a hydrogen environment as opposed to a normal air environment is considerably more costly, both due to the added cost of the hydrogen gas, but also in evacuating the furnacing chamber of air and pumping in hydrogen. As well, hydrogen poses a serious safety concern, due to its extreme flammability. For this reason, it must be pumped out of the chamber after every furnacing, leading to further expense and safety issues.

It is of great value to find and develop refractory metal powders which can be furnace under ambient conditions and achieve desirable fast cutting rates.

SUMMARY

The present invention thus provides an alloy comprising a powdered abrasive material and a refractory metal powder in which the refractory metal powder is a coated powder in which each granule of the refractory metal powder is coated by a coating material.

A core drill bit is further provided, which comprises a powdered abrasive material, a refractory metal powder and a steel tube onto which the powdered abrasive material and refractory metal powder are alloyed. The refractory metal powder is a coated powder in which each granule of the refractory metal powder is coated by one or more coating materials.

A method is also provided for manufacturing a core drill bit. The method comprises first forming a matrix by mixing together a powdered abrasive material and a coated refractory metal powder. The matrix is placed in a mould and a steel tube is placed on top of the mould to form a drill bit assembly. The drill bit assembly is then heated under atmospheric conditions. The steel tube is then hot pressed into the heated matrix and the drill bit assembly is allowed to cool before releasing the cooled drill bit from the mould.

BRIEF DESCRIPTION OF THE DRAWINGS

The present invention will now be described in greater detail, with reference to the following drawings, in which.

DESCRIPTION OF THE INVENTION

Figure 1:
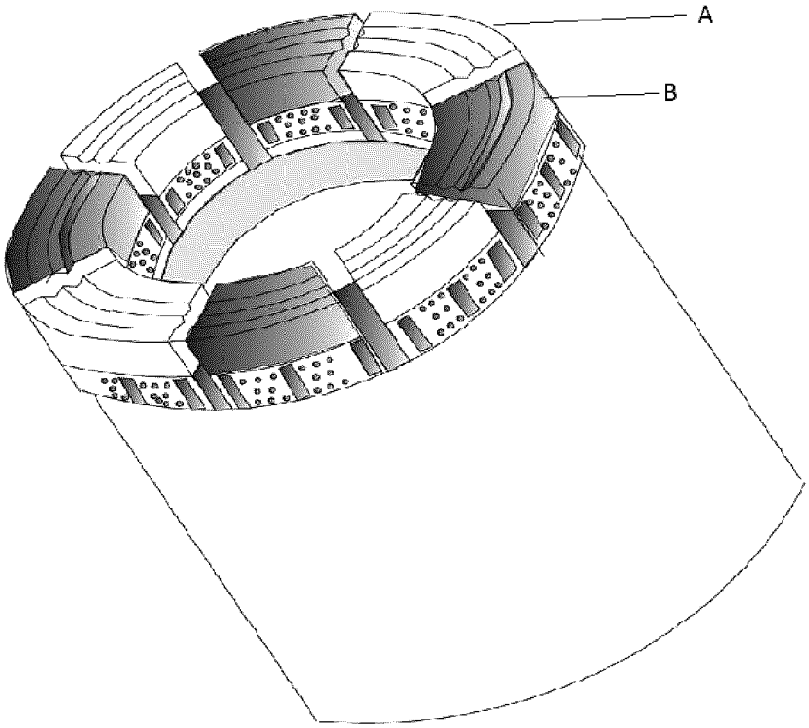
FIG. 1 is a cross sectional view of one example of a drill bit of the present invention.
Figure 1:
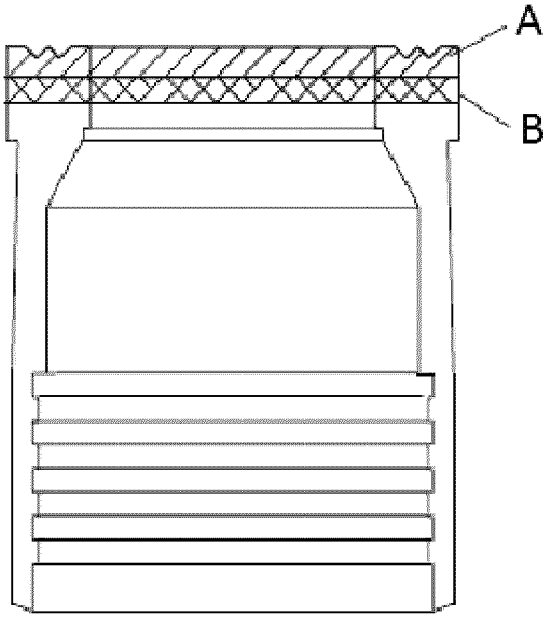

The present invention relates to matrices used in the manufacture of core drill bits. More specifically, these matrices allow for the manufacture of core drill bits under normal atmospheric manufacturing conditions while at the same time providing hardness and fast cutting rates.

Refractory metals are preferred in the matrix of core drill bits for a number of reasons. Firstly, they do not dissolve in the infiltrant. Also the hardness, strength and wear resistance of the resultant matrix can be controlled by using different particle sizes, shapes and distributions of refractory metals. As well, refractory metals yield a resultant matrix that shows greater resistance to thermal deformation than matrices that contain a non-refractory metal. Even when the drill bit is cooled by water, the rock/diamond interface generates a lot of heat, and non-refractory metals tend to lose strength quickly at these high temperatures. The loss of strength often results in the diamond grit particles sinking into the matrix and not providing the desirable cutting protrusions. Alternately the shape of the bit can become deformed, for instance the original cylindrical shape changes to a "mushroom" or "bell" shape which in turn can create interference between the drill bore and the tool.

Refractory metal powders bestow a high melting point to the resultant alloy, also called a matrix. This is important as the abrasive grit in the core drill bit results in very high temperatures during use and requires a high melting point matrix surrounding it to prevent deformation.

The matrices of the present invention is comprised of a refractory metal powder that is protected from oxidation and can therefore be furnaced under atmospheric conditions. The present inventors have found that by coating refractory metal powders in one or more layers of coating materials, they can be protected from oxidation during furnacing. More particularly, each granule of refractory metal powder is coated with one or more layers of coating materials. The coatings can be achieved by any number of known methods in the art, including spray coating, plasma spray methods and fluidized methods. It will be clearly understood by a person skilled in the art that any suitable method of powder coating known in the art can be used in the present invention without departing from the scope thereof. The coating around each granule is typically 5 to 30% by weight of the weight of each refractory metal granule to be coated.

The organic binder can be any suitable binder known in the art, including but not limited to mineral oils, mineral soaps and greases commonly known in the art.

The infiltrant is most commonly copper, but can also include silver or alloys of copper and silver, copper/nickel/zinc alloys, copper/manganese/nickel/zinc alloys and copper/zinc/tin, among others. Alternatively, the infiltrant can be comprised of a mixture of pure granules of copper, nickel, zinc, manganese or silver, which is allowed to melt and alloy during the heating process.

The coating materials can be any number of types of materials including metals and metal alloys. Preferably, coating metals or alloys are used that have high melting points and typically do not melt or deform during the furnacing process. The coating metals can more preferably be one or more of nickel, copper, steel, tungsten or alloys thereof.

Alternately, the coating materials can be the same as the infiltrant in manufacturing the drill bit. In such cases, a thicker coating is applied to each refractory metal granule and the metal or alloy coating materials act as both a coating for the refractory metal granules and as an infiltrant, thereby eliminating the need for adding infiltrant to the drill bit at a later stage in the manufacturing process.

Alternately, the coating material could be applied in one or more layers. For example, the coating material could comprise an inner layer formed of a high melting point material, for example nickel, followed by one or more outer layers of a lower melting point material, for example an alloy of copper and silver. One or more of the outer layers can optionally be the same as the infiltrant, to also thereby eliminate the need for adding infiltrant to the drill bit assembly in the manufacturing process.

Furthermore, quantitative controls can be made to the bit assembly by using the present coated refractory metal powders. In one embodiment, the drill bit assembly can be made with varying coating compositions either over the length of the bit or radially around the drill bit. For example, the top of the bit can have a composition of 82% Cu 18% Ag, and the composition could incrementally be changed to 65% Cu/15% Ni/20% Zn near the bottom of the drill bit, by adding the multi-layer coated refractory powder in layers or zones. In this case, the Cu/Ni/Zn alloy provides improved brazing and adhesion to the steel tube, while the Cu/Ag alloy allows the diamond grit to cut rock more quickly. In cases where the geology of the formation to be drilled is well known, the bit can be incrementally layered to provide an optimal matrix alloy at each depth of drilling, rather than depending on one alloy to work throughout the formation. For example, if it is known that the first 100 meters of a formation is relatively soft, a 82%Cu/18% Ag coating could be used. If deeper into the formation the rock gets harder, a coating of 70%Cu/30% Ag could be layered under the first coating layer. Using a multi-layered powder in a layered or zoned application, it is possible to customize drill bits for use in particular formations. The or zones can be oriented to change either radially, as illustrated by zones A and B in FIG. 1*a*), or over the length of the drill bit, as illustrated by zones A and B in FIG. 1*b*).

By coating each granule or particle of the refractory metal powder, a number refractory metals previously unsuitable for atmospheric furnacing can now be employed in manufacture of the drill bit. These include, but are not limited to, niobium and molybdenum, both of which are softer metals than typically used tungsten and thus yield faster cutting rates when alloyed into drill bits. Tungsten and tungsten carbide refractory metal powders coated according to the present invention have also worked well and are possible refractory metals for the present invention. Other refractory metals suitable for the present invention include tantalum, osmium and rhenium.

Furthermore, no alteration or retrofit to the existing moulds and furnacing conditions are required in using the present group of coated metal powders.

The inventors have achieved excellent results in using the present coated metal powders. Particularly the present group of coated refractory metal particles showed little to no oxidation even when the drill bit is furnace in atmospheric conditions. The coating of each particle of refractory metal powder acts to hermitically seal and protect the surface of the refractory metal particles from oxidation. This allows for better wetting with the infiltrant and other matrix materials. Better wetting in turn results in stronger adhesion between matrix materials and a stronger drill bit.

Figure 2:
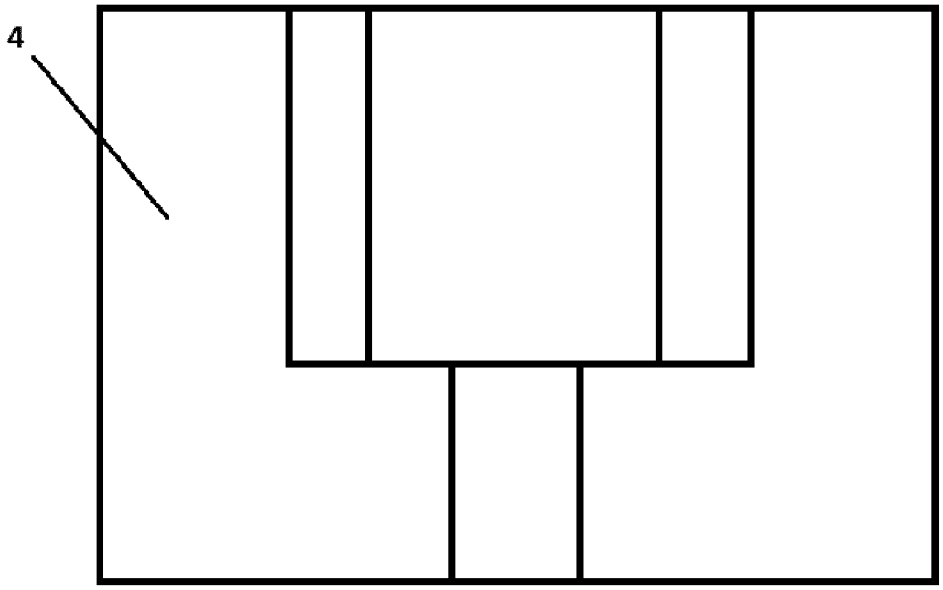
FIG. 2 is a cross sectional view of one example of a mould used in manufacturing drill bits of the present invention.
Figure 3:
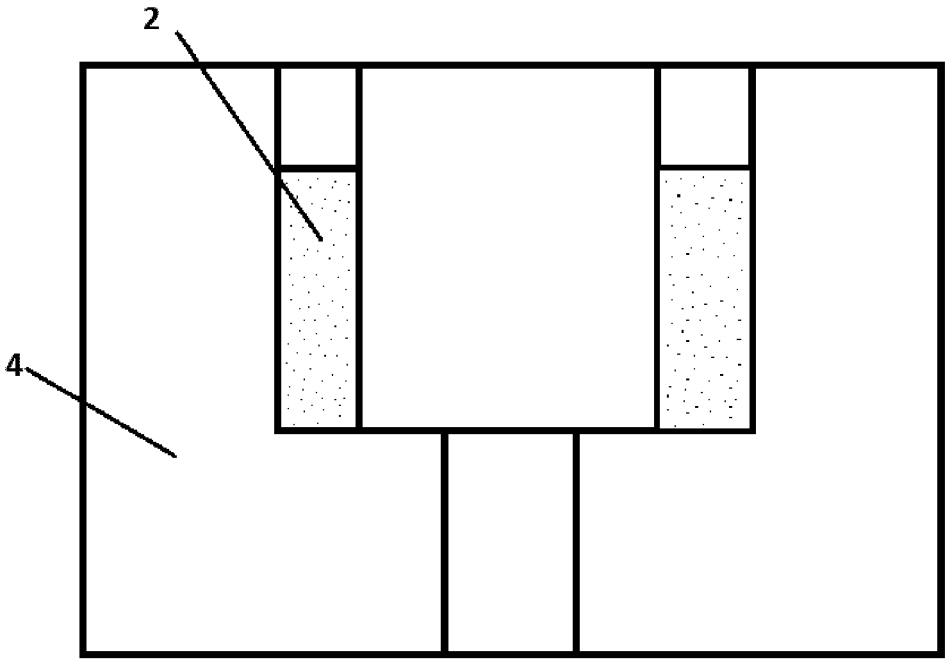
FIG. 3 is a cross sectional view of one example of a mould loaded with a matrix of the present invention.

With reference to FIGS. 2 and 3, in the present method the abrasive grit material, and the coated refractory metal powder are mixed together to form a matrix powder 2 and placed in a mould 4. The mould 4 is commonly graphite, but could be made of any suitable material for the present furnacing purposes. It would be easily understood by a person of skill in the art that the mould material could be varied without departing from the scope of the present invention.

Figure 4:
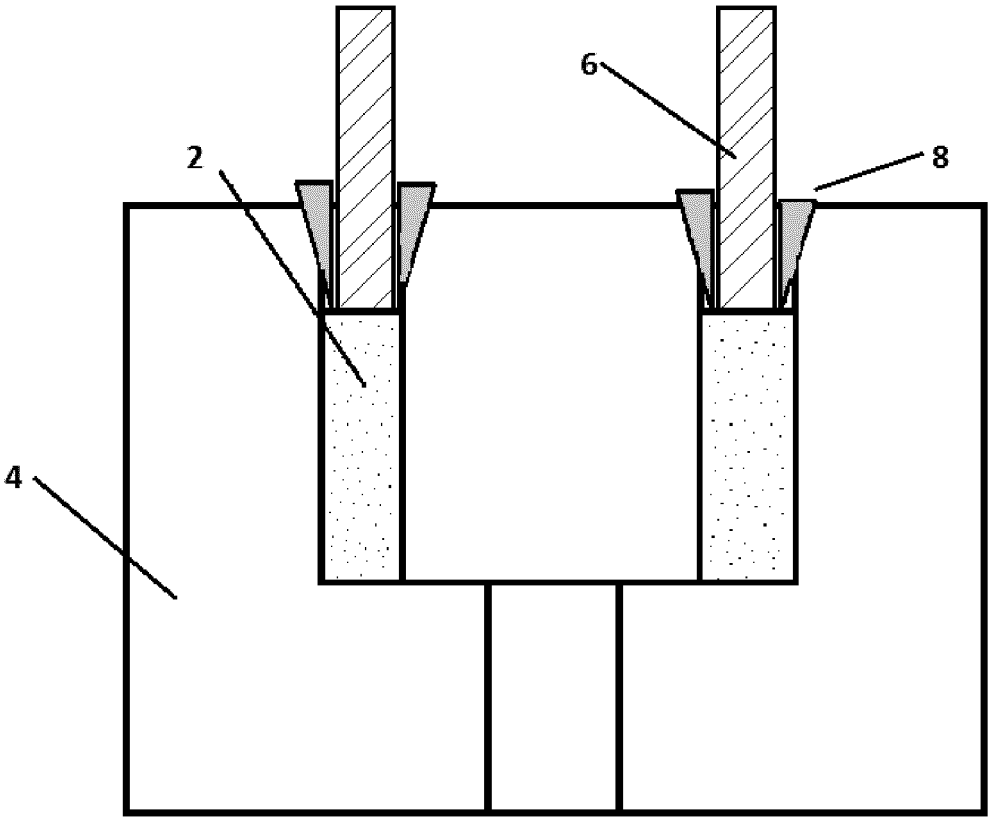
FIG. 4 is a cross sectional view of one example of a mould loaded with a matrix of the present invention, a steel tube and an infiltrant.
Figure 5:
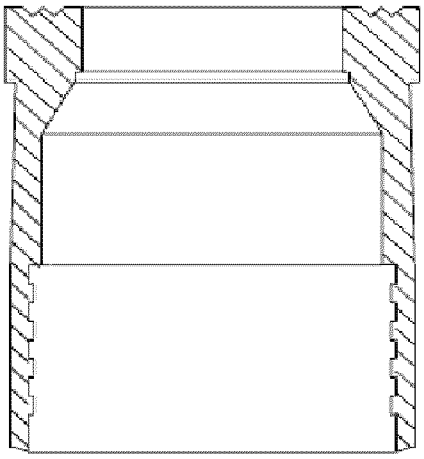
FIG. 5 is a cross sectional view of a further example of a drill bit of the present invention.

As illustrated in FIG. 4, a steel tube 6 is then placed on top of the mould 4. In cases where the coating materials do not comprise an infiltrant, an infiltrant 8 is optionally added to the mould 4 to infiltrate the powdered mixture and promote wetting to the steel tube 6 surface and the assembly is heated, or furnaced, in atmospheric conditions. In such cases, the assembly is heated to achieve at least the melting temperature of the infiltrant 8, so that the infiltrant 8 melts into and fills the spaces between the refractory metal powder granules and the diamond particles and wets the steel tube 6 surface, allowing the steel tube 6 to be braised to the assembly. Preferably, the entire assembly is heated for from 5 to 20 minutes and allowed to cool in the mould 4, then released. The final drill bit is illustrated in FIG. 5.

Figure 6:
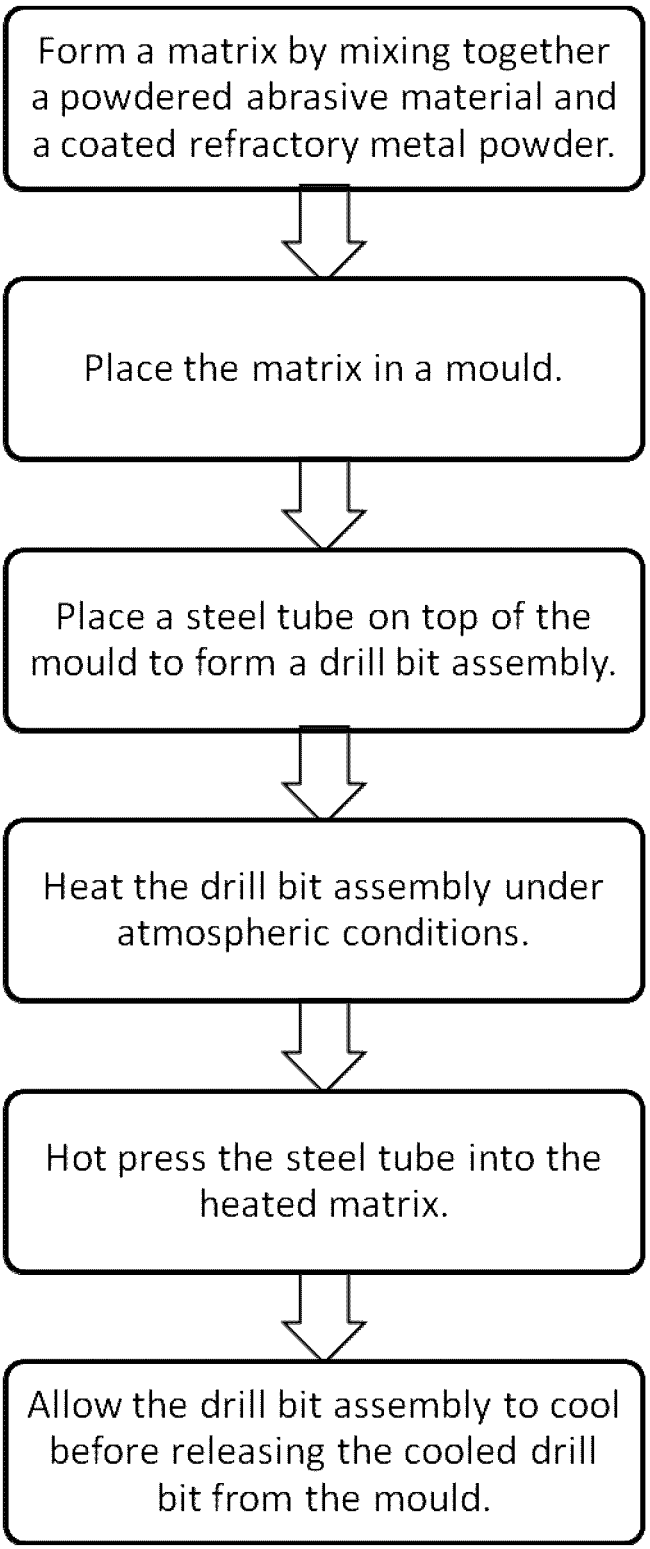
FIG. 6 is a process diagram illustrating one embodiment of the method of the present invention.

One example of the method of the present invention is illustrated in FIG. 6.

The steel tube 6 surface may preferably be brazed to further promote wetting and adhesion.

In cases where the coating materials comprise at least in part a material that is the same as the infiltrant 8, addition of further infiltrant 8 can be optionally omitted. Alternatively, infiltrant 8 can be added in lesser quantities than in cases when the coating materials do not comprise an infiltrant 8.

If the coating material comprises at least some infiltrant 8, the assembly is heated or furnaced at temperatures less than the melting point of the coating material, preferably up to 80% of the melting point temperature. At such temperatures, with applied pressure, the coated refractory powder can be consolidated to the final drill bit shape without melting the coating material.

Furnacing temperature depends upon a number of factors including the type of coating material or materials used to coat the refractory metal powder granules. Lower melting point coating materials can also be used, which allows for furnacing at lower temperatures, leading to both an energy consumption and cost savings in operation.

Alternately, by applying a thicker layer of coating materials to the refractory metal powder granules, the drill bit matrix can be furnaced without reaching the liquidus temperature of the coating materials. This in turn could allow for the use of stronger resultant drill bit matrices, for example, by incorporating steel as both the coating and the infiltrant 8.

The present coated refractory metal powders can be used in a number of mineral and geotechnical exploration applications including making large diameter core drill bits, or for making drill bits for use at the end of long drill strings for deep hole drilling, or for abrasive drilling conditions in which broken rock bits can otherwise quickly abrade the drill bit.

Furthermore, the present invention can also be applied to the coating of any refractory metal to allow for direct air casting while preventing oxidation. This is particularly desirable when reducing atmospheric controls are not possible due to manufacturing conditions or equipment limitations.

The present invention can further be used whenever refractory metals are combined with high thermal conductivity infiltrants such as, for example, in high voltage and high amperage switch manufacturing.

EXAMPLES

The following examples serve merely to further illustrate embodiments of the present invention, without limiting the scope thereof, which is defined only by the claims.

Example 1

A core drill bit of the present invention was manufactured in which the drill bit matrix comprised diamond grit as the abrasive material and molybdenum powder as the refractory metal powder. Each granule of molybdenum powder was spray coated with a layer of nickel as the coating material. The matrix was placed in a graphite mould and a clean, sandblasted steel tube placed on top. An infiltrant alloy comprising 82% by weight of copper and 18% by weight of silver was added to the assembly. The entire assembly was then heated to a furnacing temperature of 2150° F. and furnace for 7 minutes.

The system is then hot pressed for ten minutes. In hot pressing, a pressure of approximately 100 pounds is placed on the steel tube to thereby push it into the heated and plastically deformable matrix. The load is maintained as the assembly cools, until the matrix is no longer plastic, typically at about 800° F. Optical pyrometers are used to measure the temperature. The assembly is cooled in air to room temperature and then released from the graphite mould. The resultant core drill bit has an outside diameter of 2.980" and an inside diameter of 1.875".

Example 2

A core drill bit of the present invention was manufactured in which the drill bit matrix comprised diamond grit as the abrasive material and molybdenum powder as the refractory metal powder. Each granule of molybdenum powder was spray coated with a layer of nickel as the coating material. The matrix was placed in a graphite mould and a clean, sandblasted steel tube placed on top. An infiltrant 65% by weight of copper and 35% by weight of silver in the form of a mixture of pure granules of copper and silver was added to the assembly. The entire assembly was then heated to a furnacing temperature of 2150° F. and furnace for 7 minutes.

The system is then hot pressed for ten minutes. In hot pressing, a pressure of approximately 100 pounds is placed on the steel tube to thereby push it into the heated and plastically deformable matrix. The load is maintained as the assembly cools, until the matrix is no longer plastic, typically at about 800° F. Optical pyrometers are used to measure the temperature. The assembly is cooled in air to room temperature and then released from the graphite mould. The resultant core drill bit has an outside diameter of 2.980" and an inside diameter of 1.875".

In the foregoing specification, the invention has been described with a specific embodiment thereof; however, it will be evident that various modifications and changes may be made thereto without departing from the broader spirit and scope of the invention.

I claim:

1. A core drill bit comprising:

a. a powdered abrasive material;

b. a refractory metal powder; and c. a steel tube onto which the powdered abrasive material and refractory metal powder are alloyed, wherein the refractory metal powder is a coated powder in which each granule of the refractory metal powder is coated by one or more coating materials to hermetically seal said granule and to thereby prevent oxidation of metal in said granule;

said one or more coating materials is non-uniform throughout said drill bit such that a composition of said one or more coating materials coating said refractory metal powder at a first portion of said drill bit is different from a composition of said one or more coating materials for said refractory metal powder at a second portion of said drill bit.

2. The core drill bit of claim 1 further comprising an infiltrant for enhancing wetting of the steel tube.

3. The core drill bit of claim 2, wherein the infiltrant comprises one or more metals or metal alloys.

4. The core drill bit of claim 3, wherein the infiltrant is selected from the group consisting of copper, silver, zinc, tin, nickel, manganese, steel and alloys thereof.

5. The core drill bit of claim 1, wherein the one or more coating materials are selected from metals and metal alloys.

6. The core drill bit of claim 5, wherein the one or more coating materials are selected from the group consisting of nickel, copper, zinc, manganese, tin, steel, tungsten and alloys thereof.

7. The core drill bit of claim 1, wherein the one or more coating materials act as both the refractory powder coating and as an infiltrant to enhance wetting of the steel tube.

8. The core drill bit of claim 7, wherein the one or more coating materials comprise one or more metals or metal alloys.

9. The core drill bit of claim 8, wherein the one or more coating materials are selected from the group consisting of copper, silver, zinc, tin, nickel, manganese, steel and alloys.

10. The core drill bit of claim 1, wherein the one or more coating materials comprise one or more layers of coating materials.

11. The core drill bit of claim 10, wherein the one or more layers of coating materials comprise an inner coating layer adjacent the refractory metal powder granule and one or more outer coating layers built up on the inner coating layer.

12. The core drill bit of claim 11, wherein the outer coating layer comprises a material that acts as an infiltrant to enhance wetting of the steel tube.

13. The core drill bit of claim 1, wherein the abrasive material is diamond grit.

14. The core drill bit of claim 1, wherein the refractory metal powder is selected from a group of refractory metals consisting of niobium, molybdenum, tantalum, tungsten metal, tungsten carbide, rhenium, and osmium.

15. A method of manufacturing a core drill bit, said method comprising:

a. forming a matrix by mixing together a powdered abrasive material and a coated refractory metal powder;

b. placing the matrix in a mould;

c. placing a steel tube on top of the mould to form a drill bit assembly;

d. heating the drill bit assembly under atmospheric conditions;

e. hot pressing the steel tube into the heated matrix; and f. allowing the drill bit assembly to cool before releasing the cooled drill bit from the mould;

wherein the coated refractory metal powder is a coated powder in which each granule of the coated refractory metal powder is coated by one or more coating materials to hermetically seal said granule and to thereby prevent oxidation of metal in said granule;

said one or more coating materials is non-uniform throughout said drill bit such that a composition of said one or more coating materials coating said refractory metal powder at a first portion of said drill bit is different from a composition of said one or more coating materials for said refractory metal powder at a second portion of said drill bit.

16. The method of claim 15, wherein each granule of the coated refractory metal powder is coated by one or more coating materials selected from the group consisting of metals, metal alloys.

17. The method of claim 15, further comprising the step of adding an infiltrant to the drill bit assembly prior to heating, to enhance wetting of the steel tube.

18. The method of claim 17, wherein the infiltrant comprises one or more metals or metal alloys.

19. The method of claim 18, wherein the infiltrant is selected from the group consisting of copper, silver, zinc, tin, nickel, manganese, steel and alloys thereof.

20. The method of claim 16, wherein the one or more coating are selected from the group consisting of copper, silver, zinc, tin, nickel, manganese, steel, tungsten and alloys thereof.

21. The method of claim 15, wherein each granule of the coated refractory metal powder is coated by one or more materials that act as both a coating material and as an infiltrant to enhance wetting of the steel tube.

22. The method of claim 21, wherein the one or more materials comprise one or more metals or metal alloys.

23. The method of claim 22, wherein the one or more materials are selected from the group consisting of copper, silver, zinc, tin, nickel, manganese, steel and alloys thereof.

24. The method of claim 15, wherein each granule of the coated refractory metal powder is coated by one or more layers of coating materials.

25. The method of claim 24, wherein the one or more layers of coating materials comprises an inner coating layer adjacent the refractory metal powder granule and one or more outer coating layers built up on the inner coating layer.

26. The method of claim 25, wherein the outer coating layer comprises a material that acts as an infiltrant to enhance wetting of the steel tube.

27. The method of claim 15, wherein the abrasive material is diamond grit.

28. The method of claim 15, wherein the refractory metal powder is selected from the group consisting of niobium, molybdenum, tantalum, tungsten metal, tungsten carbide, rhenium, and osmium.

29. The method of claim 17, wherein the assembly is heated to at or above the liquidus temperature of the infiltrant.

* * * * *